US006167224A

United States Patent [19]

Dalal

[11] Patent Number: 6,167,224

[45] Date of Patent: Dec. 26, 2000

[54] METHOD FOR APPLYING UNIFORM GLOSS OVER THE ENTIRE PRINT

[75] Inventor: Edul N. Dalal, Webster, N.Y.

[73] Assignee: Xerox Corporation, Stamford, Conn.

[21] Appl. No.: 09/437,120

[22] Filed: Nov. 10, 1999

[51] Int. Cl.[7] ..... G03G 15/01; G03G 15/06

[52] U.S. Cl. ..... 399/222; 399/223; 430/45

[58] Field of Search ..... 399/54, 147, 184, 399/222, 223, 226; 430/45, 100

[56] References Cited

U.S. PATENT DOCUMENTS 3,901,698 8/1975 Fukushima et al. ..... 430/100
4,828,950 5/1989 Crandall ..... 430/45
5,260,753 11/1993 Haneda et al. ..... 399/54
5,612,777 3/1997 Malhotra ..... 399/226
5,613,176 3/1997 Grace ..... 399/223
5,751,432 5/1998 Gwaltney ..... 399/147 X
5,751,437 5/1998 Parker et al. ..... 399/184 X

*Primary Examiner*—Fred L. Braun
*Attorney, Agent, or Firm*—Lloyd F. Bean, II

[57] ABSTRACT

A printing system using a recharge, expose and development image on image process color system in which there is an optional gloss development step is employed that results in the image having an uniform gloss and toner pile height. The printing system may be a single pass system where all of the color are developed in a single pass or a multi-pass system where each color is developed in a separate pass. The additional gloss development step results in optimal color quality.

5 Claims, 2 Drawing Sheets

METHOD FOR APPLYING UNIFORM GLOSS OVER THE ENTIRE PRINT

CROSS REFERENCE

Cross-reference is made to concurrently filed patent application Ser. No. 09/437,117 entitled; APPARATUS AND METHOD FOR FORMING A TONER IMAGE WITH LOW TONER PILE HEIGHT, by Edul N. Dalal.

This invention relates generally to color imaging employed in electrography to produce a print and the use of plural exposure and development steps for such purposes and more particularly to a method and an apparatus for applying uniform gloss over the entire print.

BACKGROUND OF THE INVENTION

One method of printing in different colors is to uniformly charge a charge retentive surface and then expose the surface to information to be reproduced in one color. This information is rendered visible using marking particles followed by the recharging of the charge retentive surface prior to a second exposure and development. This recharge/expose/and develop (REaD) process may be repeated to subsequently develop images of different colors in superimposed registration on the surface before the full color image is subsequently transferred to a support substrate. The different colors may be developed on the photoreceptor in an image on image development process, or a highlight color image development process (image next-to image). Each different image may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

A major image quality drawback of xerography is "differential gloss", where the gloss of white or non-image areas (bare paper) is usually very different from that of fully-toned areas. This becomes particularly important in high-quality xerographic applications competing in a market accustomed to the look and feel of lithography. It is even more important for more demanding applications which require the look and feel of photography.

A solution to this problem involves the use of a "white printer", typically the addition of clear toner which has a gloss characteristic similar to the other toners. In one approach the entire page would be covered with clear toner, but this would not quite solve the differential gloss issue, since gloss is dependent on the local toner mass per unit area. Moreover, this would also further increase the toner pile height which in typical xerographic printers is already too large. Another approach involves the use of the image-wise deposition of clear toner, limiting it to the areas where there is no other toner present. This would solve the differential gloss problem, but requires a separate ROS (or another pass in multi-pass systems) and the creation of another separation, clear toner in addition to the normal CMYK separations, adding to computational cost.

The differential gloss characteristic of xerography is a major source of dissatisfaction in high-quality applications. Other image quality attributes of xerography have been greatly improved in recent years, but potential users accustomed to lithography typically object to xerographic images because of their differential gloss. Moreover, there is now considerable interest in pursuing photography-like applications using xerography. Ordinary xerographic images have been shown to look almost like photography, solely by providing a very uniform image gloss by placing the image behind a transparent film.

An object of the present invention is directed to a method to apply clear toner to achieve high-quality images at much lower cost and/or at higher speed than previously possible.

SUMMARY OF THE INVENTION

There is provided a method for creating image on image process color images representing a document in a printing machine including: recording a first latent image on a charge retentive surface moving along an endless path; developing image regions of said latent image with a first colored development material; discharging non image regions on the charge retentive surface; and developing the non image regions on the charge retentive surface with a clear gloss development material.

DETAILED DESCRIPTION OF THE INVENTION

Figure 1:
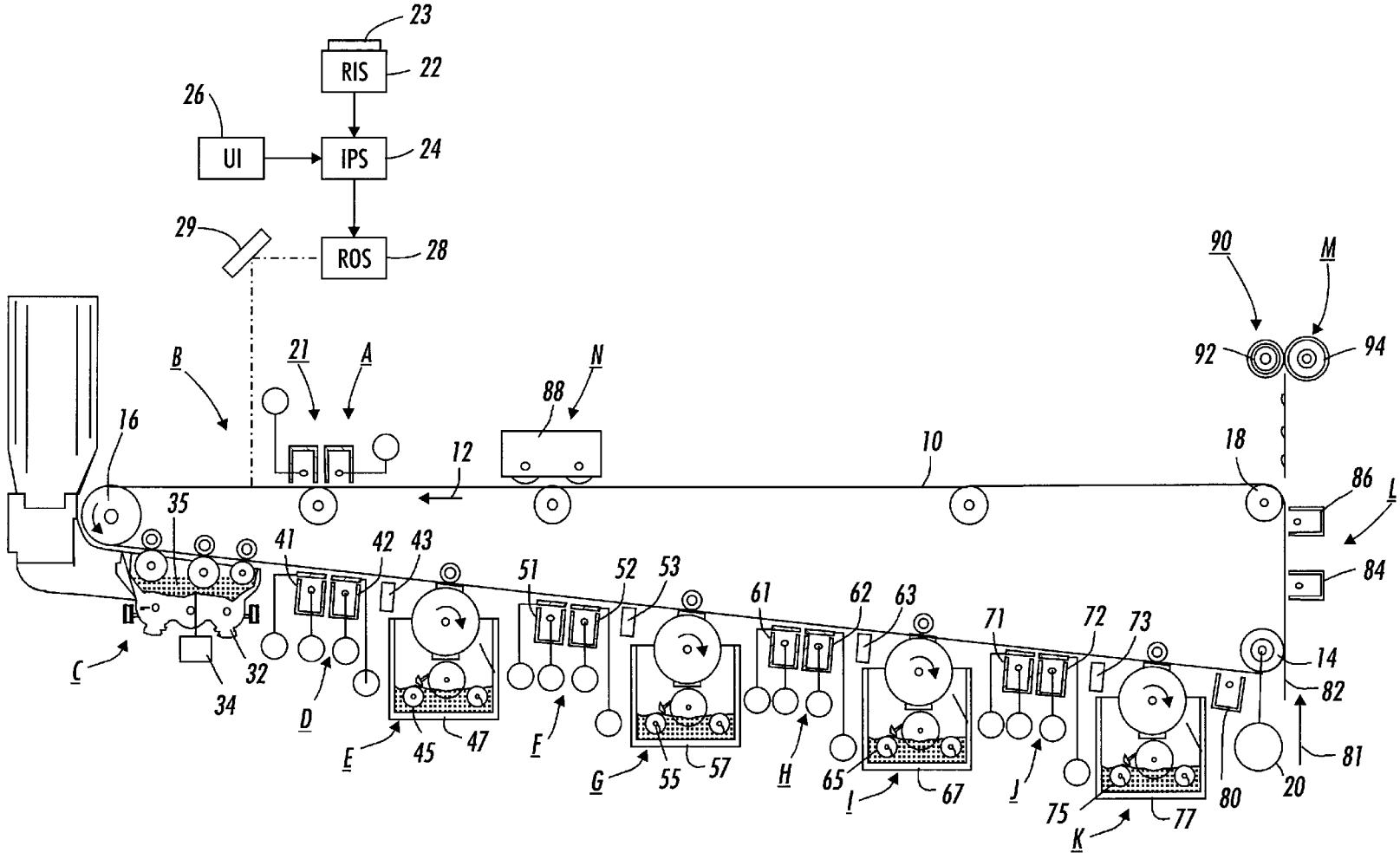
FIG. 1 is a schematic illustration of an example single pass imaging apparatus.

Turning now to FIG. 1, the electrophotographic printing machine uses a charge retentive surface in the form of a photoreceptor belt 10. The photoreceptor belt is supported by rollers 14, 16 and 18. Motor 20 operates the movement of roller 14, which in turn causes the movement of the photoreceptor in the direction indicated by arrow 12, for advancing the photoreceptor sequentially through the various xerographic stations.

With continued reference to FIG. 1, a portion of belt 10 passes through charging station A where a corona generating device, indicated generally by the reference numeral 21, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of the photoconductive surface is advanced through an imaging and exposure station B. A document 23, with a multi-color image and/or text original, is positioned on a raster input scanner (RIS), indicated generally by the reference numeral 22. One common type of RIS contains document illumination lamps, optics, a mechanical scanning drive and a charged coupled device. The RIS captures the entire image from original document 23 and converts it to a series of raster scan lines and moreover measures a set of primary color densities, i.e. red, green and blue densities at each point of the original document. This information is transmitted as electrical signals to an image processing system (IPS), indicated generally by the reference numeral 24. IPS 24 converts the set of red, green and blue density signals to a set of colorant signals.

The IPS contains control electronics which prepare and manage the image data flow to a raster output scanning device (ROS), indicated by numeral 28. A user interface (UI) indicated by 26 is in communication with IPS 24. UI 26 enables an operator to control the various operator adjustable functions. The operator actuates the appropriate keys of UI 26 to adjust the parameters of the copy. UI 26 may be a touch screen or any other suitable control panel providing an operator interface with the system. The output signal from UI 26 is transmitted to the IPS 24. The IPS then transmits signals corresponding to the desired image to ROS 28, which creates the output copy image. ROS 28 includes a laser with rotating polygon mirror blocks. The ROS illuminates, via mirror 29, the charged portion of a photoconductive belt 10. The ROS will expose the photoconductive belt to record single to multiple images which correspond to the signals transmitted from IPS 24.

The photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a monopolar voltage profile of high and low voltages, the former corresponding to charged areas and the latter corresponding to discharged or image areas.

A first development station C, indicated generally by the reference numeral 32, advances development material 35 into contact with the electrostatic latent image. The development housing 32 contains black toner. Appropriate developer biasing is accomplished via power supply 34. Electrical biasing is such as to effect discharged area development (DAD) of the lower (less negative) of the two voltage levels on the photoreceptor with the development material 35. This development system may be either an interactive or non-interactive system.

At recharging station D, a pair of corona recharge devices 41 and 42 are employed for adjusting the voltage level of both the toned and untoned areas on the photoreceptor surface to a substantially uniform level. A power supply coupled to each of the electrodes of corona recharge devices 41 and 42 and to any grid or other voltage control surface associated therewith, serves as a voltage source to the devices. The recharging devices 41 and 42 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 41 overcharges the photoreceptor surface 10 containing previously toned and untoned areas, to a level higher than the voltage level ultimately required for $V_{ddp}$ for example to −700 volts. The predominant corona charge delivered from corona recharge device 41 is negative. The second corona recharge device 42 reduces the photoreceptor surface 10 voltage to the desired $V_{ddp}$, −500 volts. Hence, the predominant corona charge delivered from the second corona recharge device 42 is positive. Thus, a voltage split of 200 volts is applied to the photoreceptor surface. The voltage split (Vsplit) is defined as the difference in photoreceptor surface potential after being recharged by the first corona recharge device and the second corona recharge device, e.g. $V_{split}$=−700 volts (−500 volts) =−200 volts. The surface 10 potential after having passed each of the two corona recharge devices, as well as the amount of voltage split of the photoreceptor, are preselected to otherwise prevent the electrical charge associated with the developed image from substantially reversing in polarity, so that the occurrence of under color splatter (UCS) is avoided. Further, the corona recharge device types and the voltage split are selected to ensure that the charge at the top of the toner layer is substantially neutralized rather than driven to the reverse polarity (e.g. from negative to become substantially positive).

The recharge devices have been described generally as corona generating devices, with reference to FIG. 1. However, it is understood that the recharge devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

A high slope, voltage sensitive DC device is used for the first corona recharge device, and a high slope, voltage sensitive AC device is used for the second corona recharge device. This configuration accomplishes the stated objectives of achieving voltage uniformity between previously toned areas and untoned areas of the photoreceptor so that subsequent exposure and development steps are effected across a uniformly charged surface; as well as reducing the residual charge of the previously developed areas so that subsequent development steps are effected across a uniform development field. Further, these objectives are successfully attained while ensuring that toner charge at the top of the toner layer is substantially neutralized rather than driven to reverse its polarity, so that UCS occurrence is avoided.

A second exposure or imaging device 43 which may comprise a laser based output structure is utilized for selectively discharging the photoreceptor on toned areas and/or bare areas to approximately −50 volts, pursuant to the image to be developed with the second color developer. After this point, the photoreceptor contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material 45 comprising, for example, yellow color toner is employed. The toner is contained in a developer housing structure 47 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 45.

At a second recharging station F, a pair of corona recharge devices 51 and 52 are employed for adjusting the voltage level of both the toned and untoned areas on the photoreceptor to a substantially uniform level. A power supply coupled to each of the electrodes of corona recharge devices 51 and 52 and to any grid or other voltage control surface associated therewith, serves as a voltage source to the devices. The recharging, imaging and developing process is similar to that of stations D and E and will not be described in detail. This image is developed using a third color toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 62 are employed for adjusting the voltage level of both the toned and untoned areas on the photoreceptor to a substantially uniform level. A power supply coupled to each of the electrodes of corona recharge devices 61 and 62 and to any grid or other voltage control surface associated therewith, serves as a voltage source to the devices. The recharging and developing processes are again similar to those described for stations D and E and will not be described in detail.

A fourth latent image is created using an imaging or exposure device 63. A fourth DAD image is formed on both bare areas and previously toned areas of the photoreceptor that are to be developed with the fourth color image. This image is developed, for example, using a cyan color toner 65 contained in developer housing 67 at a fourth developer station I. Suitable electrical biasing of the housing 67 is provided by a power supply, not shown.

The present invention adds a fourth recharging station J, a pair of corona recharge devices 71 and 72 are employed for adjusting the voltage level of both the toned and untoned areas on the photoreceptor to a substantially uniform level. A power supply coupled to each of the electrodes of corona recharge devices 71 and 72 and to any grid or other voltage control surface associated therewith, serves as a voltage source to the devices. Again the recharging, imaging and developing steps are similar to that of stations D and E.

A fifth latent image is created using a flash exposure device 73. A fifth DAD image is formed on bare areas only of the photoreceptor that are to be developed. This image is developed using a clear color toner 75 contained in developer housing 77 at a fifth developer station K. Suitable electrical biasing of the housing 77 is provided by a power supply, not shown.

The developer housing structures 47, 57, 67 and 77 are preferably of the type known in the art which do not interact, or are only marginally interactive with previously developed images. For example, a DC jumping development system, a powder cloud development system, and a sparse, non-contacting magnetic brush development systems are each suitable for use in an image on image color development system. A non-interactive, scavengeless development housing having minimal interactive effects between previously deposited toner and subsequently presented toner is described in U.S. Pat. No. 4,833,503, the relevant portions of which are hereby incorporated by reference herein.

In order to condition the toner for effective transfer to a substrate, a negative pre-transfer corotron member 80 delivers negative corona to ensure that all toner particles are of the required negative polarity to ensure proper subsequent transfer. Another manner of ensuring the proper charge associated with the toner image to be transferred is described in U.S. Pat. No. 5,351,113, the relevant portions of which are hereby incorporated by reference herein.

Subsequent to image development a sheet of support material 82 is moved into contact with the toner images at transfer station L. The sheet of support material is advanced to transfer station L by conventional sheet feeding apparatus, not shown. Preferably, the sheet feeding apparatus includes a feed roll contacting the uppermost sheet of a stack of copy sheets. The feed rolls rotate so as to advance the uppermost sheet from a stack into a chute which directs the advancing sheet of support material into contact with the photoconductive surface of belt 10 in a timed sequence so that the toner powder image developed thereon contacts the advancing sheet of support material at transfer station L.

Transfer station L includes a transfer corona device 84 which sprays positive ions onto the backside of sheet 82. This attracts the negatively charged toner powder images from the belt 10 to sheet 82. A detack corona device 86 is provided for facilitating stripping of the sheets from the belt 10.

After transfer, the sheet continues to move, in the direction of arrow 81, onto a conveyor (not shown) which advances the sheet to fusing station M. Fusing station M includes a fuser assembly, indicated generally by the reference numeral 90, which permanently affixes the transferred powder image to sheet 82. Preferably, fuser assembly 90 comprises a heated fuser roller 92 and a backup or pressure roller 94. Sheet 82 passes between fuser roller 92 and backup roller 94 with the toner powder image contacting fuser roller 92. In this manner, the toner powder images are permanently affixed to sheet 82 after it is allowed to cool. After fusing, a chute, not shown, guides the advancing sheets 82 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles may be removed at cleaning station N using a cleaning brush structure contained in a housing 88.

The various machine functions described hereinabove are generally managed and regulated by a controller preferably in the form of a programmable microprocessor (not shown). The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The various machine functions described above are generally managed and regulated by a controller which provides electrical command signals for controlling the operations described above.

The present invention takes advantage of the intrinsic characteristics of Discharged Area Development (DAD) Image-on-Image (IOI) xerography to enable image-wise development of clear toner (i.e., the clear toner is developed only in image areas where there is no other toner) without a separate ROS station and without having to compute a "white" plane of separation for the image.

In IOI xerography, the four usual separations (CMYK, not necessarily in that order) are developed over each other directly on the photoreceptor. All four separations are then transferred simultaneously to paper. By developing the clear separation with a flood exposure after the other four separations have been developed but before transfer to paper, it is possible to use the intrinsic light-blocking property of the developed toner in a DAD system to ensure that only the untoned areas of the photoreceptor are exposed and thus discharged. The clear toner is then developed, and attaches only to the untoned areas of the photoreceptor. The entire image is then transferred to paper. Thus, the exposure can be achieved with a cheap flood-exposure system (e.g., a fluorescent or incandescent lamp) instead of an additional laser ROS station in single-pass systems. In multiple pass systems, which use a single ROS station for all separations, the clear toner can be developed in a similar manner during the final pass, eliminating the need for an additional pass and the associated loss in color printing speed.

One problem that needs to be addressed is that the CMYK toners have different optical transmittances, and the flood exposure system must ensure sufficient opacity to prevent photoreceptor discharge and hence clear toner development over even the most transmissive portion of the image. This is possible by selecting the power spectrum of the lamp, with optical filters if necessary, taking the transmittance spectrum of each toner and the sensitivity of the photoreceptor into account. Portions of the image with more than a single layer of toner (e.g., R=M+Y) will be more opaque than those with a single layer of toner (e.g., Y) but extra opacity (over the minimum required) is not a problem. In any case, some variation in development is permissible since the clear toner has low visibility.

Figure 2:
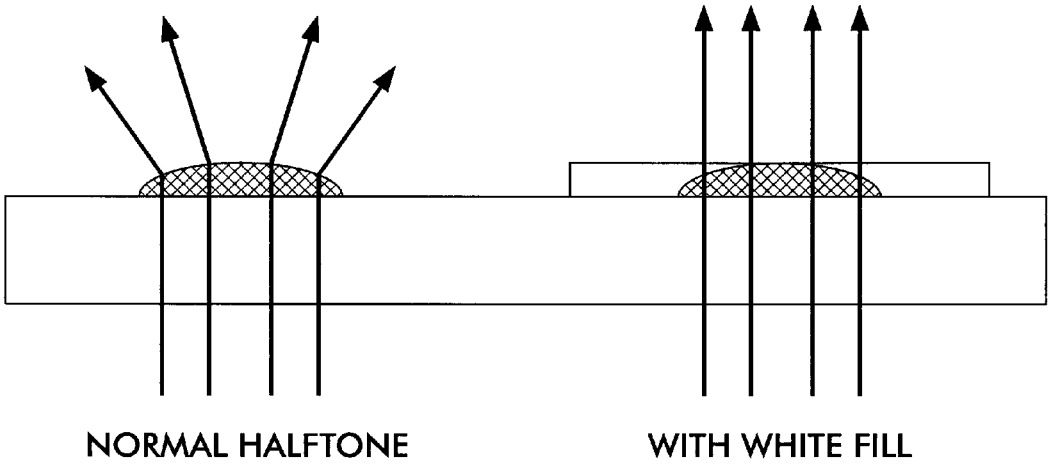
FIG. 2 is a cross section of the developed image.

Another advantage of the present invention is for overhead (OHP) transparencies. It is well known that light scattered from the curved surfaces of halftoned areas causes darkening and desaturation of projected color, especially in highlight areas where the dots are small and isolated. Filling in the non-image areas with clear toner will eliminate the curved surfaces and prevent this problem (see FIG. 2).

Additionally, there is potential benefit of reduced image distortion during transfer because the image areas are "supported" by the clear toner.

It is, therefore, apparent that there has been provided in accordance with the present invention, a method and apparatus for creating multiple images in which a corona generating device serves two purposes that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method for creating image on image process color images representing a document in a printing machine comprising:

recording a first latent image on a charge retentive surface moving along an endless path;

developing image regions of said latent image with a first colored development material;

discharging non image regions on the charge retentive surface; and developing the non image regions on the charge retentive surface with a clear gloss development material.

2. The method for creating images as claimed in claim 1, wherein said discharging step includes flood exposure illuminating said first developed latent image.

3. The method for creating images as claimed in claim 1, further including the steps of:

recharging said developed first colored image on the charge retentive surface;

recording a second latent image on said developed first colored image said charge retentive surface; and developing the second latent image with a second colored development material before said discharging step.

4. The method for creating images as claimed in claim 3, wherein said discharging step includes flood exposure illuminating said first developed latent image and said second developed latent image.

5. The method for creating images as claimed in claim 4, wherein said flood exposure illuminating includes the step of adjusting illumination level, in response to differences in transmittance between said first colored development material and said second colored development material.

* * * * *